US005595369A

United States Patent [19]

Hull

[11] Patent Number: 5,595,369

[45] Date of Patent: Jan. 21, 1997

[54] NAIL EXTRACTING DEVICE

[76] Inventor: Anthony Hull, 169 Louth Street, St. Catharines, Ontario, Canada, L2S 2R4

[21] Appl. No.: 501,374

[22] Filed: Jul. 12, 1995

[51] Int. Cl.[6] ..... B25C 11/00

[52] U.S. Cl. ..... 254/26 R

[58] Field of Search ..... 254/26 R, 26 E, 254/25; 81/20

[56] References Cited

U.S. PATENT DOCUMENTS

| | | | |
|---|---|---|---|
| 918,219 | 4/1909 | Swan | 254/25 |
| 1,660,237 | 2/1928 | Small | 254/26 R |
| 2,983,297 | 5/1961 | Wilson | 254/26 R |
| 4,482,132 | 11/1984 | Lamansky | 254/26 R |

*Primary Examiner*—Robert C. Watson

[57] ABSTRACT

In accordance with the present invention, there is provided an apparatus for extracting an embedded or long nail comprising:

a) a first front body section having first and second ends wherein a vertical striking surface is provided at said first end;

b) a second body section integrally connected to the second end of said first front body section, said second body section having:

i) a bottom wall and opposite side walls projecting upwardly from the edges of said bottom wall, ii) upstanding handle means connected to the top of said side walls, iii) an opening in said bottom wall centrally disposed beneath said handle means, and iv) a horizontal V-shaped cut in said bottom wall, said cut facing into said opening; and c) a rear body section having bottom and opposite vertical side walls integrally connected to the bottom and side walls of said second body section, wherein the bottom wall of said rear body section is curved upwardly and rearwardly and having a V-shaped cut in the distal end of said bottom wall.

8 Claims, 7 Drawing Sheets

NAIL EXTRACTING DEVICE

BACKGROUND OF THE INVENTION

1. Field of the Invention

This invention relates to construction hand tools and, more particularly, to nail extracting devices.

2. Description of the Prior Art

Problems are encountered in fully extracting an embedded nail particularly if the nail head is broken or somehow damaged to the point where it can no longer be extracted by the use of a claw hammer, crow bar or the like.

There are a variety of nail pulling devices on the market, however they all have limited specific functions. The slide hammer uses its handle to deliver an impact to its two claws which are in turn driven in behind the nail head. The tool is then pulled towards the operator, one of the claws is held stationary by being utilized as the tool's fulcrum and as the assembly is pulled, pressure is exerted on the two claws to clamp the nail between them. There is sufficient pressure to maintain a grip on the nail, thus allowing the nail to be extracted. This tool is mostly used by people who disassemble packing crates because it must be used on softer metal nails which are not spiralled. This tool cannot be used to extract nails that stand partially out of the wood. This tool is large and cumbersome and difficult to utilize in the construction industry.

The only tool that is currently available which is suitable for the construction industry is a ½ inch round piece of steel with one end flattened to slightly resemble the shape of a snake's head. A V-shape is punched at the end of the flattened end. This head in turn is bent 90 degrees to the shaft. Because the V-shape is close to the fulcrum a great deal of energy is derived from a minimum of effort. This tool is driven under the nail head most commonly by a hammer, the operator then pulls back on the shaft which in turn pulls the nail up. This tool can only be used to start the extraction process of the nail and is utilized as one of a number of tools used to fully extract a nail. An efficient worker will always have his starter tool in his tool belt, however these tools are as long as the average hammer which means that it will bounce on your leg as you move. Most often these tools are left where they were last used and consequently become lost.

The flat bar is used to minimize damage to the wood and can only be used on nails that stand proud of the wood and must be continuously blocked to fully extract long nails and so is used mostly on small nails.

The crowbar is commonly used to speed up dismantling processes or to lever heavy or resistant objects into place. Large crow bars are seldom purchased with nail removal in mind. Small crowbars have a lot of flex in them and must also be blocked to fully extract long nails. Crowbars are not commonly found in the carpenters tool belt.

Pincer pliers rely on the forearm strength of the operator to maintain sufficient pressure on the nail stem so that the nail may be extracted. This tool has good leverage but for large nails it takes a great deal of strength to maintain the grip sufficiently to extract the nail.

SUMMARY OF THE INVENTION

It is an object of the invention to provide a device that can fully extract embedded nails or long nails whose uppermost point is standing a minimum of ½ an inch proud of the wood.

It is a further object of the invention to provide a device that can fully extract embedded nails or long nails with a minimum number of operations and no moving parts.

It is a further object of the invention to start the extraction process from a fully embedded nail and through the use of positive leverage and a ratchet type system large nails are easily removed with no blocking required.

Thus, in accordance with the present invention, there is provided an apparatus for extracting an embedded or long nail comprising:

a) a first front body section having first and second ends wherein a vertical striking surface is provided at said first end;

b) a second body section integrally connected to the second end of said first front body section, said second body section having:

i) a bottom wall and opposite side walls projecting upwardly from the edges of said bottom wall, ii) upstanding handle means connected to the top of said side walls, iii) an opening in said bottom wall centrally disposed beneath said handle means, and iv) a horizontal V-shaped cut in said bottom wall, said cut facing into said opening; and c) a rear body section having bottom and opposite vertical side walls integrally connected to the bottom and side walls of said second body section, wherein the bottom wall of said rear body section is curved upwardly and rearwardly and having a V-shaped cut in the distal end of said bottom wall.

Another embodiment of the invention includes an insert located adjacent the opening in the bottom wall of said second body section. The insert adapted to grip the stem of the nail and hold it while the handle means is rotated about the tail section. When the handle is fully rotated the insert's grip on the nail stem can be released and then reapplied lower down the stem closer to the wood so that a long nail can be fully extracted.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
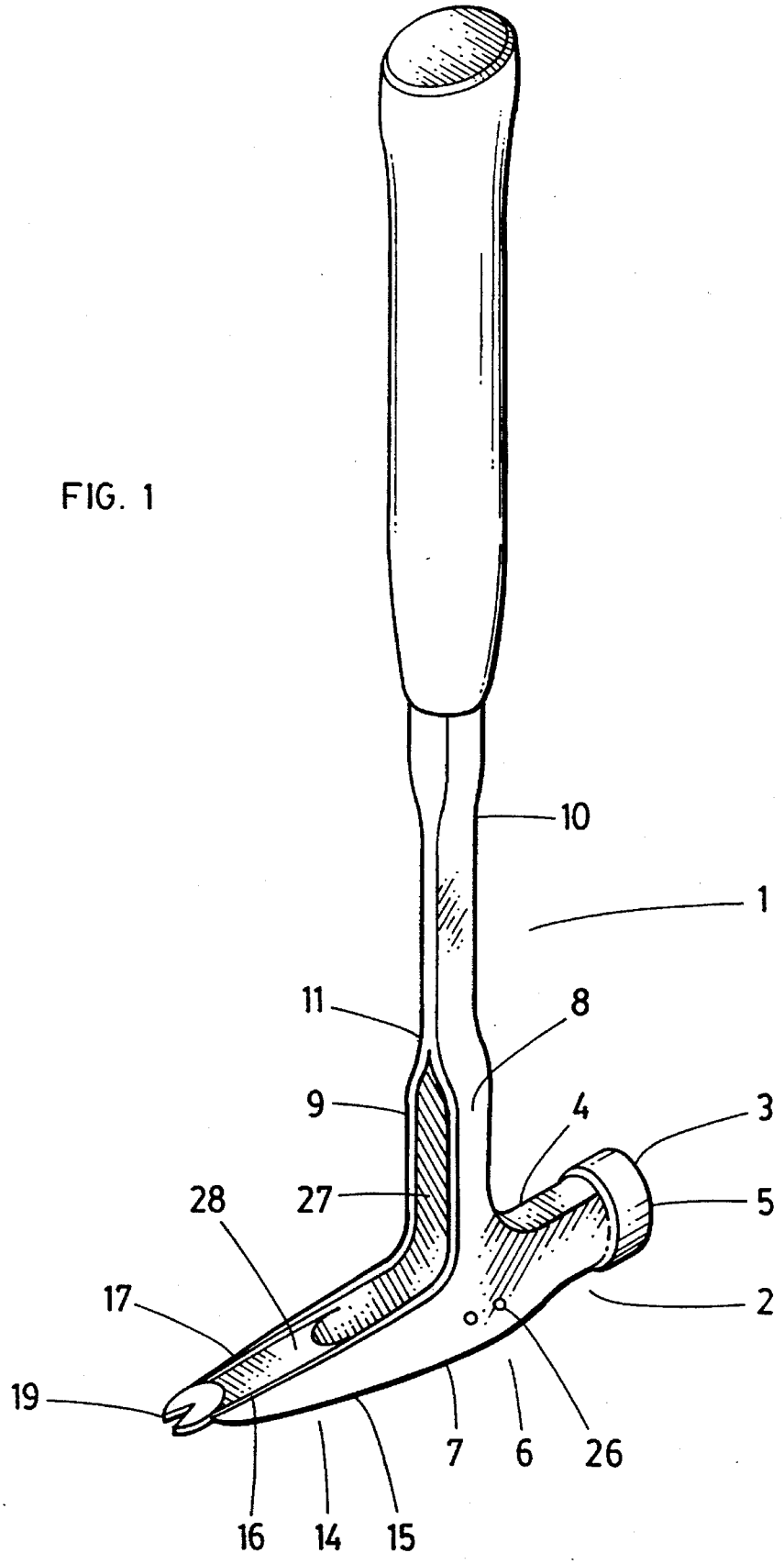
FIG. 1 is a perspective view of the invention incorporated in a hammer.
Figure 2:
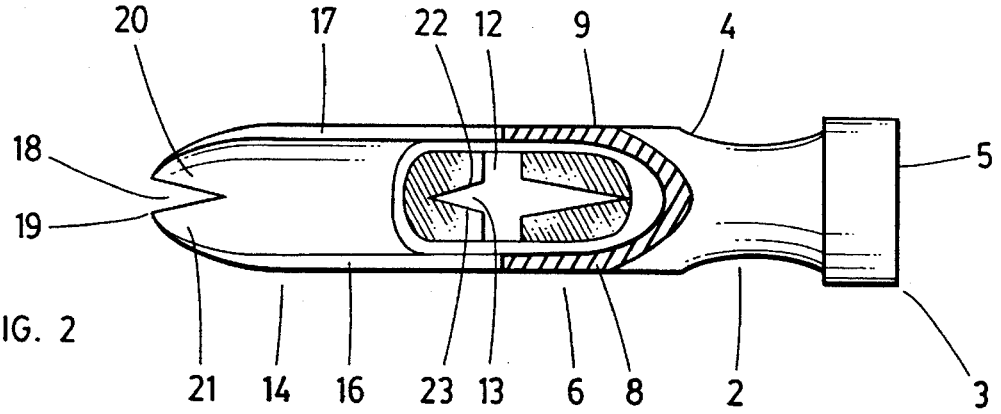
FIG. 2 is a top plan view of the head of the hammer of FIG. 1.
Figure 3:
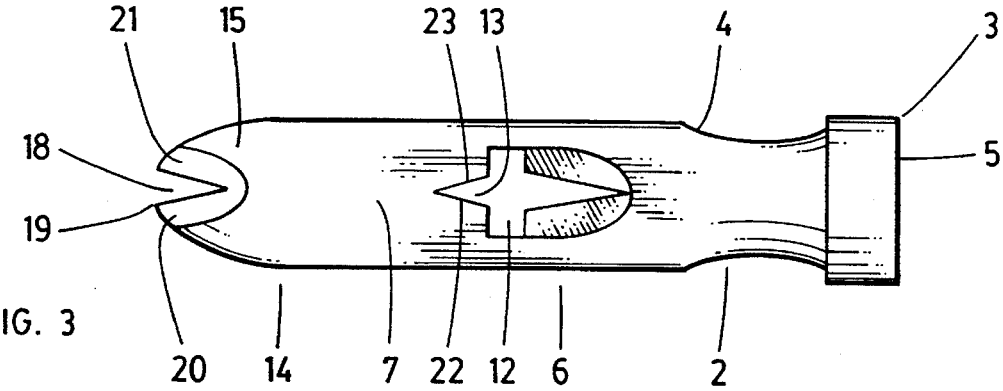
FIG. 3 is a bottom plan view of the head of the hammer of FIG. 1.

Referring to FIGS. 1–6, a nail extracting device according to the present invention is generally indicated at 1 and in the preferred embodiment illustrated can be used as a hammer. The nail extracting device 1 has a first front body section 2 having first and second ends 3 & 4 respectively. The first end 3 is adapted to form a striking or hammer face 5. A second intermediate body section 6 has a bottom wall 7 and upwardly projecting opposite side walls 8 & 9. The bottom wall 7 and opposite side walls 8 & 9 are integrally connected to the second end 4 of the front section 2. An upstanding handle means 10 is connected to the top 11 of side walls 8 & 9. An opening 12 in the bottom wall 7 is centrally disposed beneath said handle means 10. A horizontal V-shaped cut 13 is provided in the bottom wall 7 and facing into opening 12. A rear body section 14 has bottom 15 and opposite vertical side walls 16 & 17 integrally connected to the bottom 7 and side walls 8 & 9 of said second body section 6. The bottom wall 15 of said rear body section 14 is curved upwardly and rearwardly and has a V-shaped cut 18 in the distal end 19 of said bottom wall 15.

To extract an embedded nail, the rear V-shaped cut 18 is intended to be driven beneath the head of the nail by first holding the opened arms 20 & 21 of the V-shaped cut 18 at a point next to the embedded nail head. The striking or hammer face 5 is struck with a heavy object to drive the two arms 20 & 21 under the nail head. Pulling the handle means 10 so that the device rotates on the rear or tail section towards the front section 2 will cause the distal end 19 of said bottom wall 15 to raise which in turn will lift the nail. Short nails may be extracted fully with this operation.

To extract long nails that cannot be fully extracted as described above the following procedure is utilized. The head of the nail is inserted through opening 12 with sides 22 & 23 of V-shaped cut 13 under the raised head of the nail. The handle means 10 is pulled to rotate the hammer on the tail or rear section 15 towards the rear. This will take advantage of the fulcrum close to the nail which results in easier extraction with less effort. Use of the V-shaped cut will completely extract shorter nails and raise long nails to a sufficient height to allow the inserts as shown in FIGS. 5–11 to be utilized.

The V-shaped cut 13 may be moved towards the hammer face 5, closer to the longitudinal axis of handle means 10. This will allow longer nails to be completely extracted by better utilization of the length of pull available.

Figure 4:
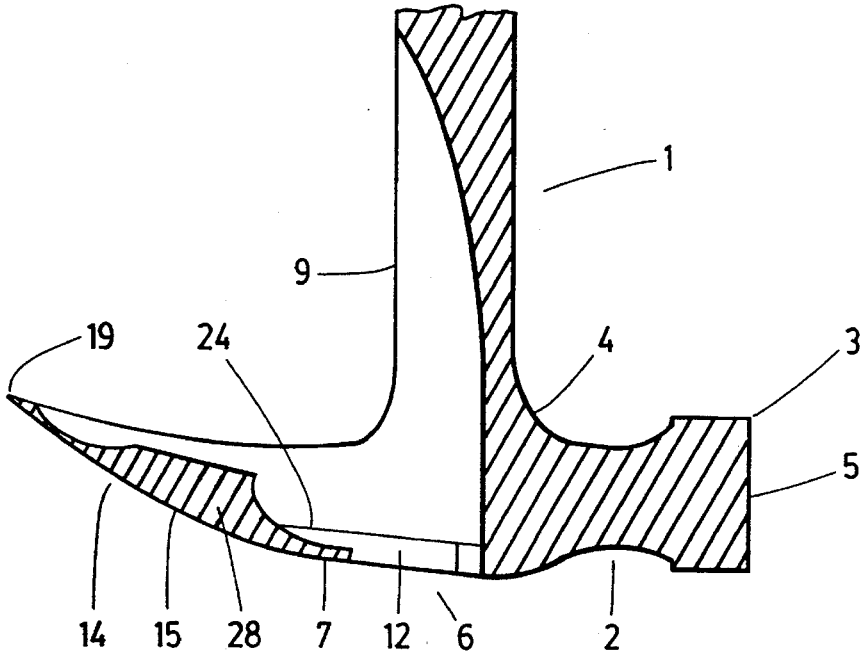
FIG. 4 is a vertical cross section through the hammer head of FIGS. 1–3.
Figure 5:
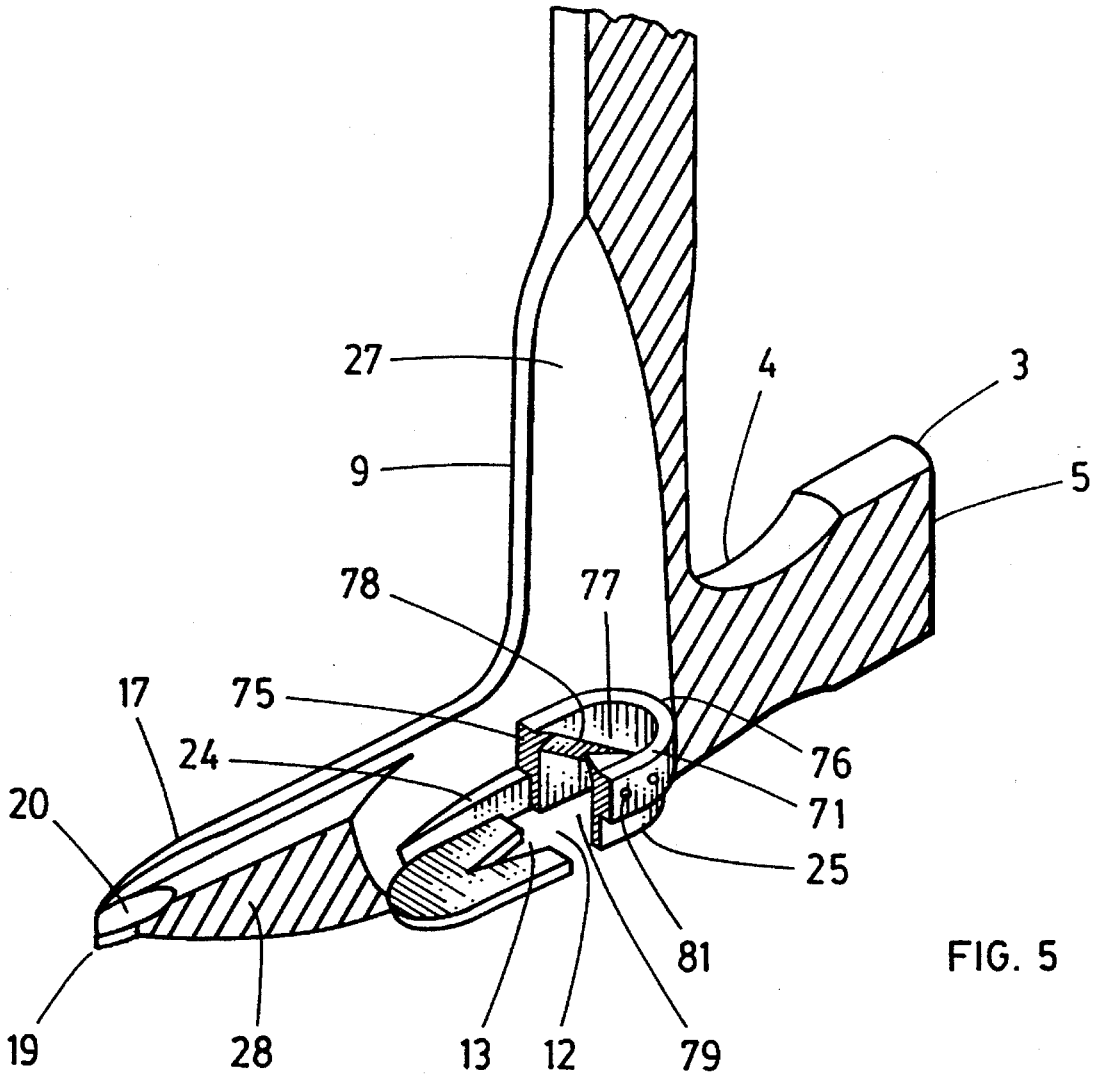
FIG. 5 is an isometric view partially in cross section of the hammer head of FIG. 1 illustrating an insert of the present invention.

FIG. 4 and FIG. 5 detail a ledge 24 upon which an insert 25 may be placed in such a manner that it will not be pulled through the opening 12. Grub screws 26 or other suitable removable fastener may be used to hold the insert 25 in place. As shown in FIG. 1, the side walls 8 & 9 of second section 6 are of sufficient height that the space 27 between them is large enough to permit the extracted nails to be ejected. Preferably the side walls 8 & 9 are tapered above the space 27 to form the handle 10. The bottom wall 15 of the rear section 14 may be thickened or provided with a weight or counter weight 28.

Figure 6:
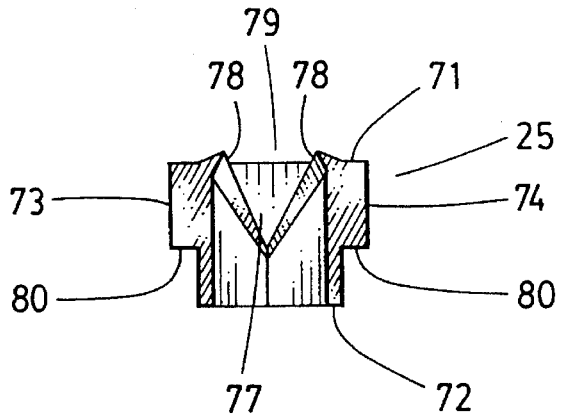
FIG. 6 is an end elevation of the insert of FIG. 5.

FIGS. 5 and 6 illustrate one type of insert 25 that can be used with the nail extracting devices of the present invention. Inserts used in accordance with this invention are all adapted to grip the stem of long nails whose uppermost point is standing a minimum of ½ an inch proud of the wood, provided the stem of the nail is in reasonable condition, and hold it while the handle is rotated about the tail section. When the handle is fully rotated the insert's grip on the nail can be released and then reapplied lower down the stem closer to the wood so that a long nail can be fully extracted. The insert 25 has no moving parts and is formed from a generally rectangular block having top and bottom surfaces 71 and 72, sides 73 and 74 and front and rear ends 75 & 76. The insert 25 has an elongated, downwardly and rearwardly inclined V-shaped opening 77. The edges 78 of the opening on the top surface 71 are sharp, tapered underneath in a manner most desirable for cutting into the nail stem. When the insert 25 is held in place in the nail extracting device, the mouth 79 of the opening 77 faces towards the tail of the tool. The inside of the side walls 8 & 9 of the nail extracting device is adapted to hold the insert in place and prevent it from being pulled through the opening 12. As shown in FIG. 5 a shoulder 24 may be provided around the periphery of opening 12 opposite V-shaped cut 13. The insert 25 is provided along both sides with overhang 80 which mates with the shoulder 24. A depression or shallow tapered hole 81 may be provided to accept the tapered end of the grub screws or other fastener used to hold the insert in place.

As illustrated in FIGS. 12 to 15, the insert can be used to remove long nails that can not be fully extracted with V-shaped cuts 18 or 13. The head of a nail 50 that is above the surface 51 of the wood is inserted into opening 12. The nail extracting device is then slid to the rear until the sharpened edges 78 of the opening 77 grip the stem of the nail. Pushing the handle to the rear to rotate on the tail section while maintaining some pressure at the base of the handle drives the sharpened edges of the V-shaped opening onto and up the nail stem. This will cause the edge to cut into the nail and cause it to be held with sufficient strength to enable the nail to pull from the wood. The pressure at the base of the handle maintains the hammer's position on the nail, which prevents the hammer from sliding up the stem of the nail. It may also be advantageous to slightly roughen the bottom surface of the tail section. Should the nail still not be extracted after full rotation of the handle, then the edges of the opening are released from the stem of the nail and the above steps repeated so that the edges grip the stem of the nail closer to the surface of the wood. The action may be repeated as often as required. It may be advantageous to straighten the nail or rotate the hammer to take advantage of a nail that can slant into the jaws of this insert.

Figure 7:
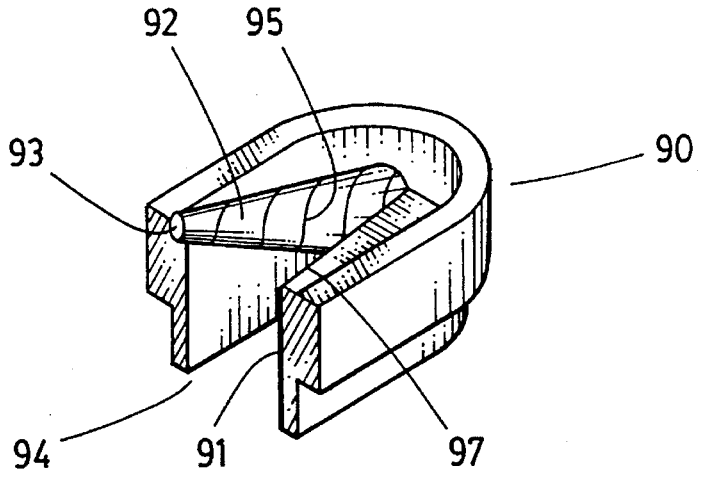
FIG. 7 is a perspective view of another insert of the present invention.

FIG. 7 illustrates another insert 90 that can be used with this invention. The insert is of similar configuration to the insert of FIG. 6 except that one side of opening 91 is provided with a truncated conical roller 92. The smaller diameter end 93 of roller 92 is located at the mouth 94 of opening 91. The surface of the roller 92 can be provided with a number of helically cut teeth 95 or other corrugated pattern and hardened in a manner which will cause the teeth 95 to bite into the nail stem. The sharp side of the helical tooth 95 faces towards the mouth 94 so that at whatever point along the nails path into the tool there will be two sharp edges cutting into the nail stem, one is the fixed edge 97 and the other is the roller teeth 95.

Figure 8:
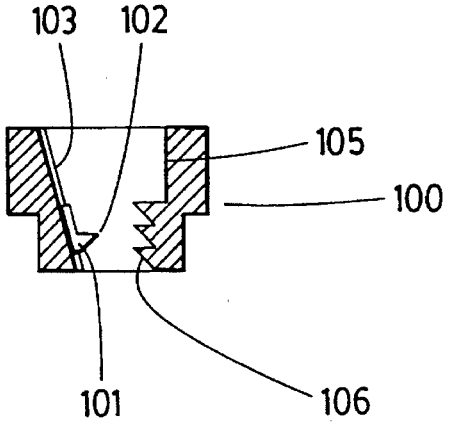
FIG. 8 is an end view of another embodiment of an insert of the present invention.
Figure 9:
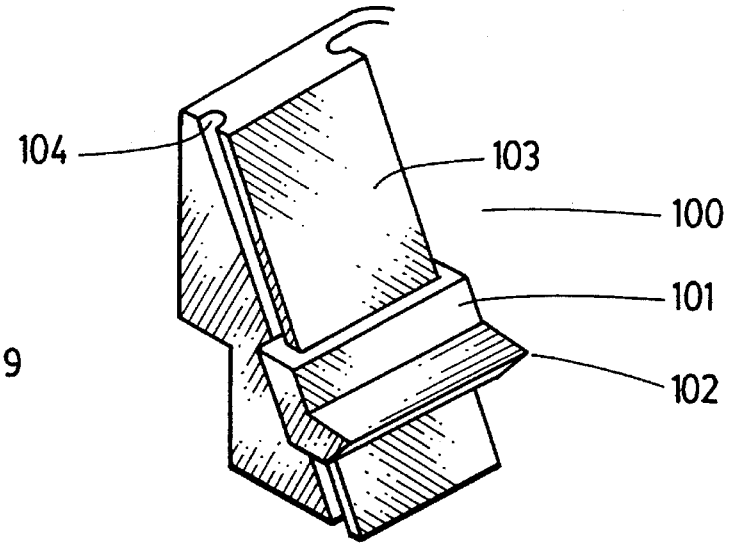
FIG. 9 is perspective enlarged view of the left side of the insert of FIG. 8.

FIGS. 8 and 9 illustrate another insert 100. Using the action of a sliding carrier 101 with a sharpened edge 102 which is able to move up and down the inclined slope 103 retained in a manner indicated by channels 104 or some similar method, and is spring biased to return to a downward position. The opposite side 105 to the carrier has a number of teeth 106 cut into the side 105. The teeth are flat on top and tapered underneath to direct the nail into the tool. The desirable improvement being the ability to remove the device or hammer without having to completely extract the nail.

Figure 10:
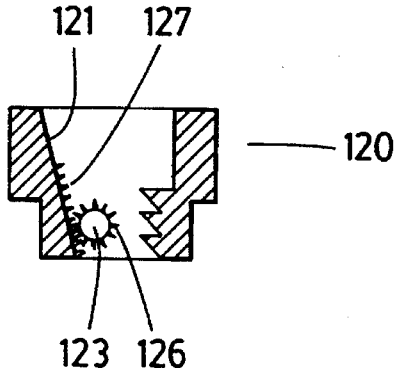
FIG. 10 is an end view of a further embodiment of the insert of the present invention.
Figure 11:
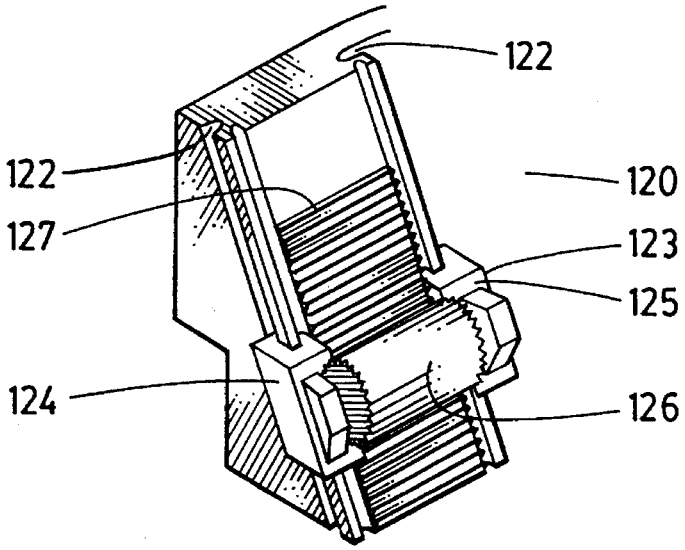
FIG. 11 is perspective enlarged view of the left side of the insert of FIG. 10.
Figure 12:
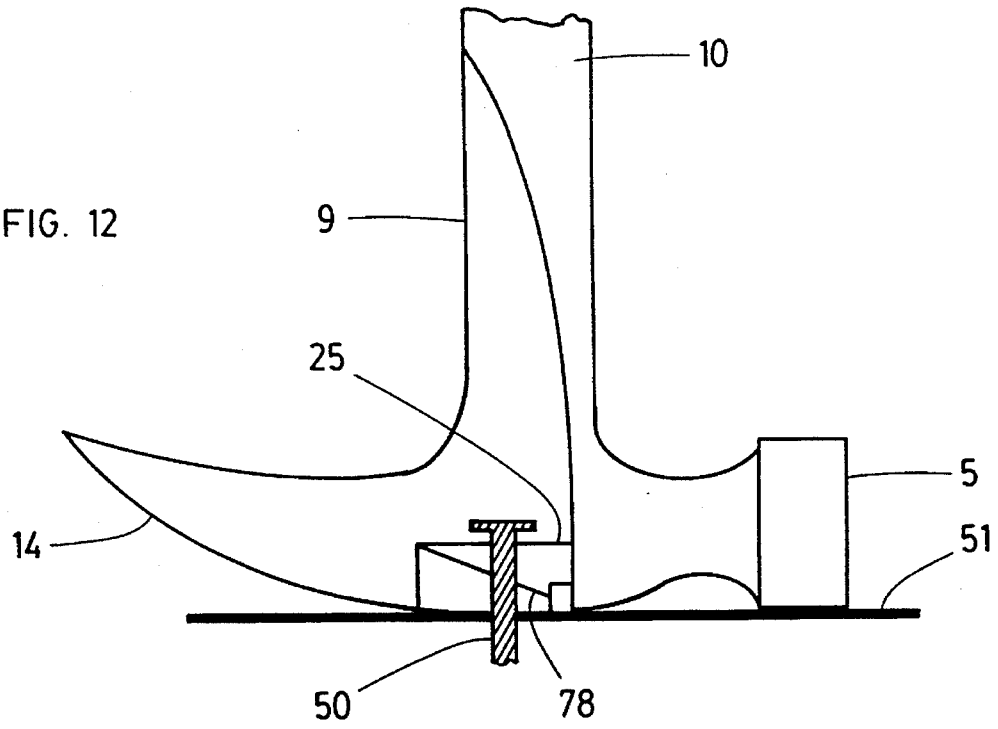
FIGS. 12 to 15 illustrate the use of the nail extracting device of the present invention to remove long nails.
Figure 13:
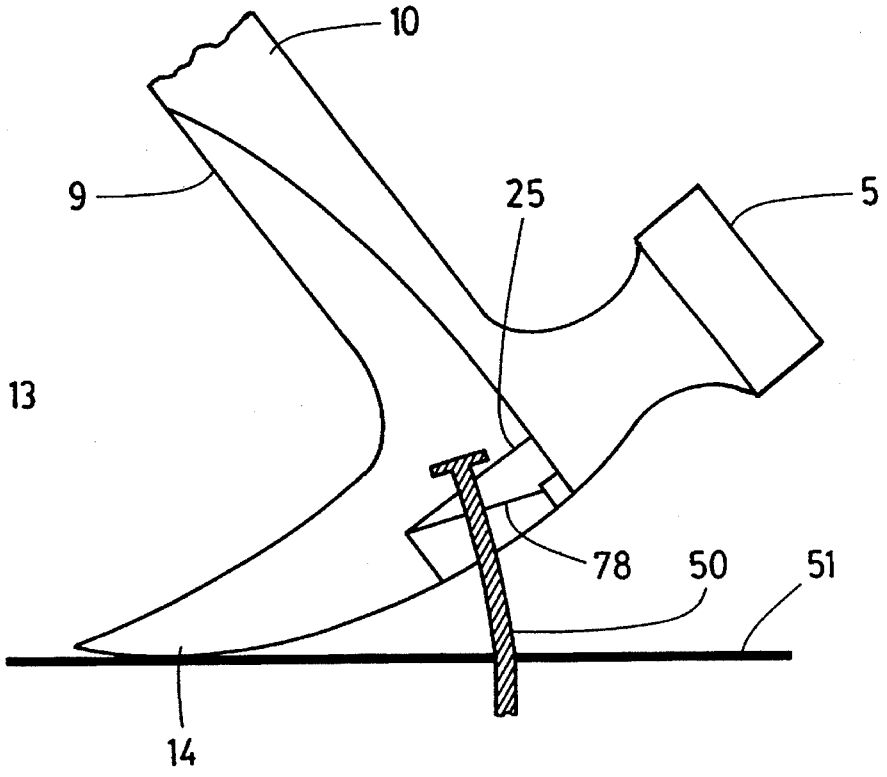
Figure 14:
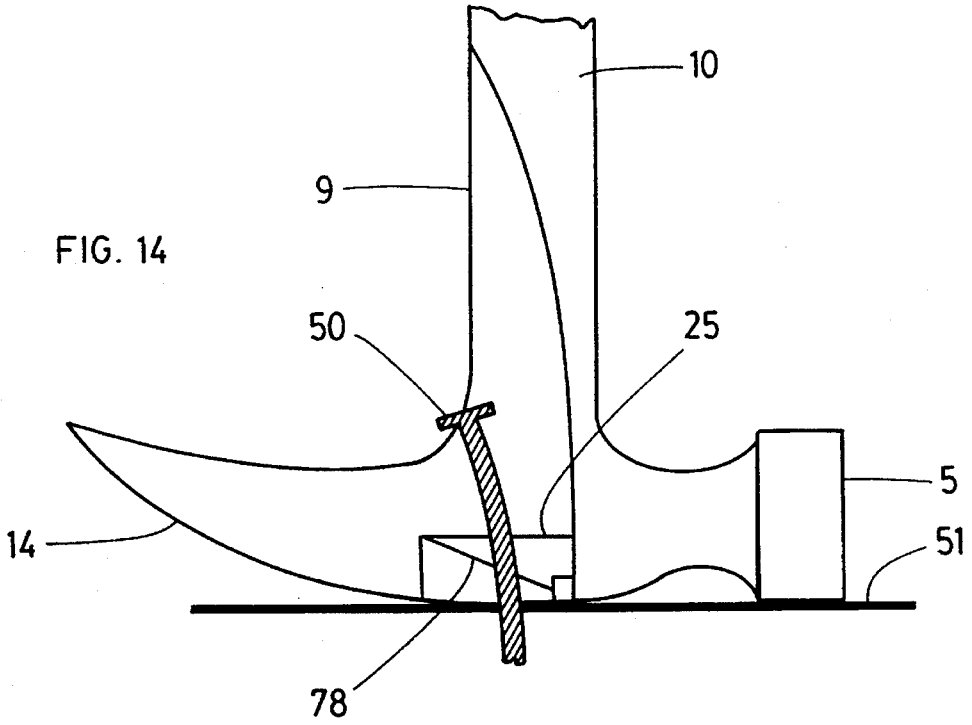
Figure 15:
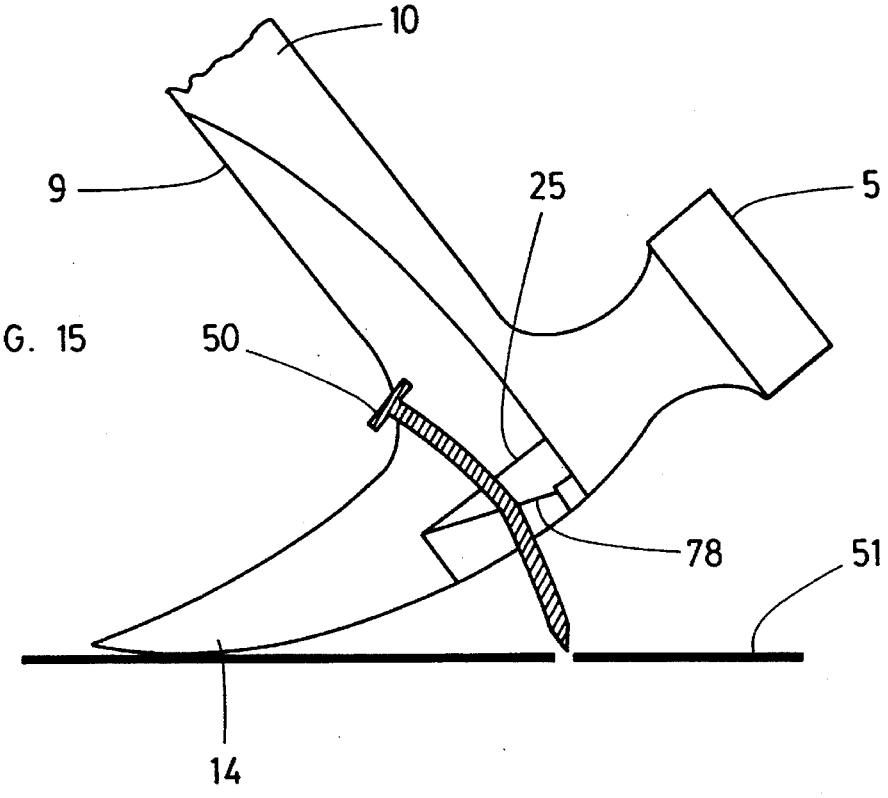

FIGS. 10 and 11 show an insert 120 of a similar shape and size to FIGS. 8 and 9 retaining the incline 121, channels 122, carrier 123. The carrier 123 is split into two halves 124 and 125, with a toothed roller 126 connecting the two halves 124 and 125. This will allow the teeth of the roller 126 to mesh with the teeth 127 on the inclined face 121. The assembly being spring biased similar to FIG. 9. Any rotation of the roller will cause the carrier to move up or down the incline. This action will benefit the compressive ability of the assembly and will always assure an equal movement of the split carrier 123.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A nail extracting device comprising:

a) a first front body section having first and second ends wherein a vertical striking surface is provided at said first end;

b) a second body section integrally connected to the second end of said first front body section, said second body section having:

i) a bottom wall and opposite side walls projecting upwardly from the edges of said bottom wall, ii) upstanding handle means connected to the top of said side walls, iii) an opening in said bottom wall centrally disposed beneath said handle means, and iv) a horizontal V-shaped cut in said bottom wall, said cut facing into said opening; and c) a rear body section having bottom and opposite vertical side walls integrally connected to the bottom and side walls of said second body section, wherein the bottom wall of said rear body section is curved upwardly and rearwardly and having a V-shaped cut in the distal end of said bottom wall.

2. A nail extracting device according to claim 1 wherein the V-shaped cut in the distal end of the bottom wall in the rear body section is adapted to be moved under the head of an embedded nail.

3. A nail extracting device according to claim 1 further comprising an insert located adjacent the opening in the bottom wall of said second body section, said insert adapted to grip the stem of the nail and hold it while the handle means is rotated about the tail section.

4. A nail extracting device according to claim 3 wherein when the handle is fully rotated the insert's grip on the nail stem can be released and then reapplied lower down the stem closer to the wood so that a long nail can be fully extracted.

5. A nail extracting device according to claim 2 wherein the side walls of said second body section are adapted to retain an insert for extracting long nails without the insert pulling through the opening in the bottom wall of the second body section.

6. A nail extracting device according to claim 3 wherein the insert is formed from a generally rectangular block having top and bottom surfaces, sides and front and rear ends; an elongated, downwardly and rearwardly inclined V-shaped opening is formed in the block wherein the edges of the opening are sharp for cutting into the nail stem.

7. A nail extracting device according to claim 6 wherein the insert is formed with one side of the opening provided with a truncated conical roller; the smaller diameter end of the roller is located at the mouth of the opening.

8. A nail extracting device according to claim 7 wherein the surface of the roller is provided with a number of helically cut teeth or other corrugated pattern and hardened in a manner which will cause the teeth to bite into the nail stem.

* * * * *